US008505299B2

(12) United States Patent
Mundra et al.

(10) Patent No.: US 8,505,299 B2
(45) Date of Patent: Aug. 13, 2013

(54) STEAM TURBINE FLOW ADJUSTMENT SYSTEM

(75) Inventors: Kamlesh Mundra, Clifton Park, NY (US); Nestor Hernandez Sanchez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 406 days.

(21) Appl. No.: 12/836,046

(22) Filed: Jul. 14, 2010

(65) Prior Publication Data

US 2012/0011852 A1 Jan. 19, 2012

(51) Int. Cl.
*F01K 13/02* (2006.01)

(52) U.S. Cl.
USPC ..... 60/660; 60/677; 60/679; 60/662; 415/116

(58) Field of Classification Search
USPC ..... 60/660, 658, 653, 677, 678, 679, 60/662, 663, 652, 661; 415/116, 151, 155, 415/159, 166, 167, 13, 17, 26, 29, 49, 50
See application file for complete search history.

(56) References Cited

U.S. PATENT DOCUMENTS

| | | | | |
|---|---|---|---|---|
| 3,848,138 | A * | 11/1974 | Park | 290/40 R |
| 4,118,935 | A | 10/1978 | Andersson | |
| 4,258,424 | A * | 3/1981 | Giras et al. | 700/290 |
| 4,403,476 | A * | 9/1983 | Johnson et al. | 60/652 |
| 2001/0042369 | A1* | 11/2001 | Wakazono et al. | 60/39.182 |
| 2003/0000214 | A1* | 1/2003 | Grewe et al. | 60/670 |
| 2010/0000216 | A1 | 1/2010 | Hofer et al. | |

FOREIGN PATENT DOCUMENTS

| | | | |
|---|---|---|---|
| EP | 0092551 | A1 | 11/1983 |
| GB | 479889 | A | 2/1935 |
| JP | 63207500 | A | 8/1988 |
| JP | 4191402 | A | 7/1992 |
| JP | 6002504 | A | 1/1994 |
| JP | 11081908 | A | 3/1999 |
| JP | 2006161698 | A | 6/2006 |

* cited by examiner

*Primary Examiner* — Kenneth Bomberg
*Assistant Examiner* — Wesley Harris
(74) *Attorney, Agent, or Firm* — Hoffman Warnick LLC; Ernest G. Cusick

(57) ABSTRACT

A steam turbine flow adjustment system. In one embodiment, the system includes a steam turbine having a first inlet port and a second inlet port for receiving inlet steam; a first conduit and a second conduit operably connected to a first valve and a second valve, respectively, the first conduit and the second conduit for providing the inlet steam to the first inlet port and the second inlet port, respectively; and a control system operably connected to the first valve and the second valve for controlling an amount of inlet steam flow admitted and pressure to each of the first inlet port and the second inlet port based upon a load demand on the steam turbine and an admission pressure of the inlet steam.

13 Claims, 2 Drawing Sheets

STEAM TURBINE FLOW ADJUSTMENT SYSTEM

BACKGROUND OF THE INVENTION

The subject matter disclosed herein relates to a flow capacity and/or partial load performance adjustment system for a steam turbine. Specifically, the subject matter disclosed herein relates to a steam turbine including one or more admission ports for redirecting steam flow to adjust the flow capacity and/or partial load performance of the overall turbine.

A steam turbine's flow passing capability can be measured as a relationship between steam mass flow and steam conditions (e.g., pressure and temperature). The flow passing capability determines whether a given steam path configuration is able to pass a required amount of steam flow. As the flow passing capability is hardware specific (controlled by the physical size of a steam path), it is subject to hardware-specific constraints such as manufacturing variations, tolerances and design flow coefficients. Due to these hardware-specific variations, design margins must be accounted for in the design of the steam turbine. Building a steam turbine according to these design margins may cause the steam turbine to operate in off-design conditions, decreasing the turbine's efficiency and/or reducing its power output capability.

Additionally, when a steam turbine power system is operating under low flow conditions (such as in instances of part load or low-part load), inefficiencies may occur, for example, in the heat recovery steam generator (HRSG) and the steam turbine. As the demand for steam turbine power production is decreased, the pressure of the steam provided to, e.g., the HRSG, is corresponding decreased and may not be optimum from the cycle efficiency perspective. This causes the HRSG to operate inefficiently, as the pressure of the steam received by the HRSG shifts in step with the pressure requirement in the steam turbine.

BRIEF DESCRIPTION OF THE INVENTION

A steam turbine flow adjustment system is disclosed. In one embodiment, the system includes a steam turbine having a first inlet port and a second inlet port for receiving inlet steam; a first conduit and a second conduit operably connected to a first valve and a second valve, respectively, the first conduit and the second conduit for providing the inlet steam to the first inlet port and the second inlet port, respectively; and a control system operably connected to the first valve and the second valve for controlling an amount of inlet steam admitted to each of the first inlet port and the second inlet port based upon a load demand on the steam turbine and an admission pressure of the inlet steam.

A first aspect of the invention includes a system comprising a steam turbine having a first inlet port and a second inlet port for receiving inlet steam; a first conduit and a second conduit operably connected to a first valve and a second valve, respectively, the first conduit and the second conduit for providing the inlet steam to the first inlet port and the second inlet port, respectively; and a control system operably connected to the first valve and the second valve for controlling an amount of inlet steam admitted to each of the first inlet port and the second inlet port based upon a load demand on the steam turbine and an admission pressure of the inlet steam.

A second aspect of the invention includes a steam turbine system including a high pressure section having: a high pressure (HP) steam turbine having a first inlet port and a second inlet port for receiving a first inlet steam; and a first conduit and a second conduit operably connected to a first valve and a second valve, respectively, the first conduit and the second conduit for providing the inlet steam to the first inlet port and the second inlet port, respectively; an intermediate pressure section including: an intermediate pressure (IP) steam turbine having a third inlet port and a fourth inlet port for receiving a second inlet steam; and a third conduit and a fourth conduit operably connected to a third valve and a fourth valve, respectively, the third conduit and the fourth conduit for providing the second inlet steam to the third inlet port and the fourth inlet port, respectively; and a control system operably connected to the first valve, the second valve, the third valve, and the fourth valve, the control system controlling an amount of the first and second inlet steam admitted to each of the first, second, third and fourth inlet ports based upon a load demand on the steam turbine and an admission pressure of the first inlet steam and the second inlet steam.

A third aspect of the invention includes a steam turbine casing having at least one of a high pressure section, an intermediate pressure section or a low pressure section, the casing including: at least two steam inlet ports in each of the at least one of the high pressure section, the intermediate pressure section or the low pressure section.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for a flow adjustment system for a steam turbine. The flow adjustment system may include one or more admission ports (and conduits) for redirecting steam flow to adjust the flow capacity and/or partial load performance in the overall turbine. While aspects of the invention may provide a variety of benefits, certain aspects are described more specifically herein. For example, aspects of the invention provide for steam turbine power augmentation (e.g., during times of increased load) and increased steam turbine efficiency under part-load conditions.

Figure 1:
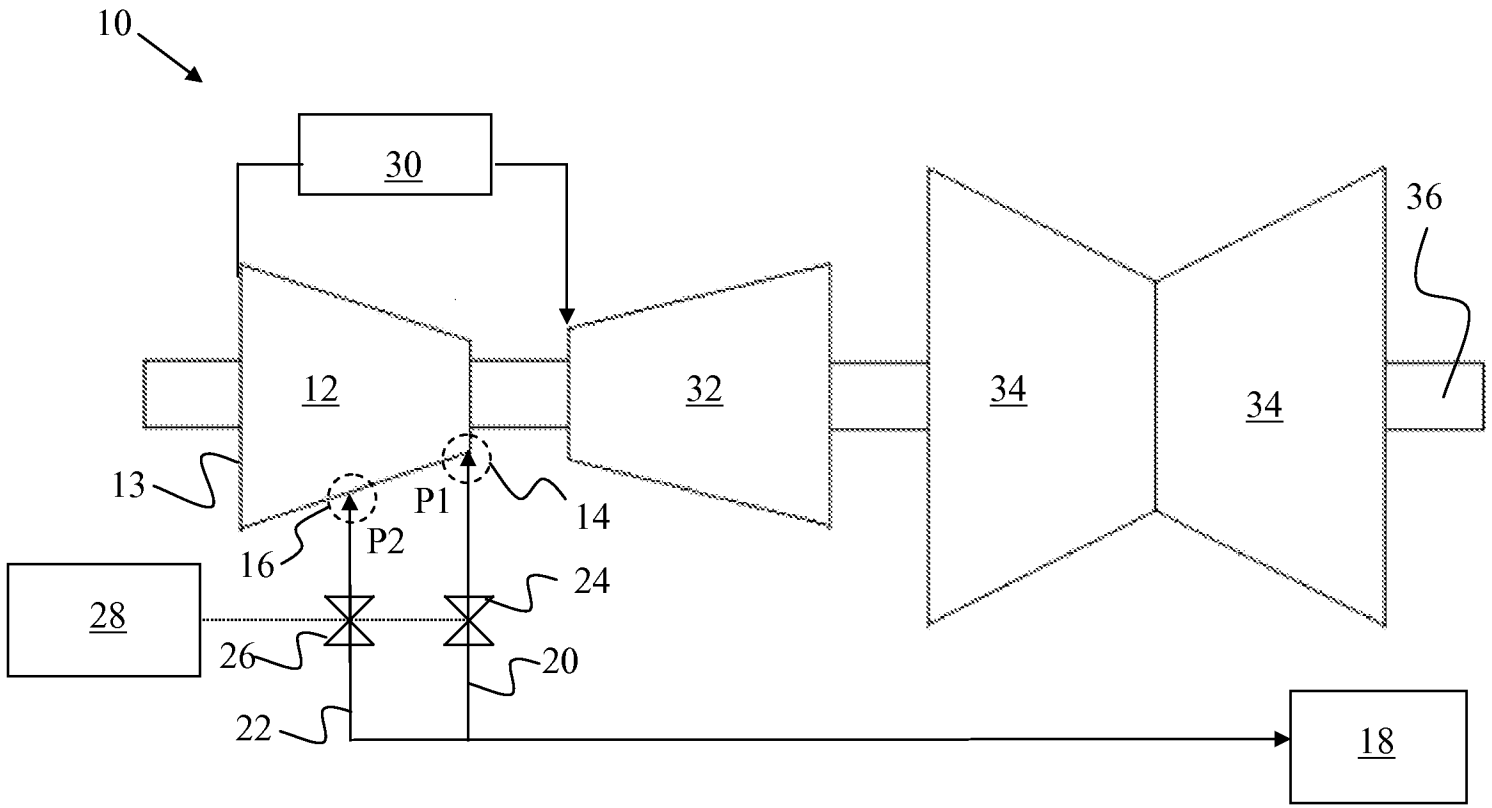
FIG. 1 shows a schematic view of a system according to an embodiment of the invention.
Figure 2:
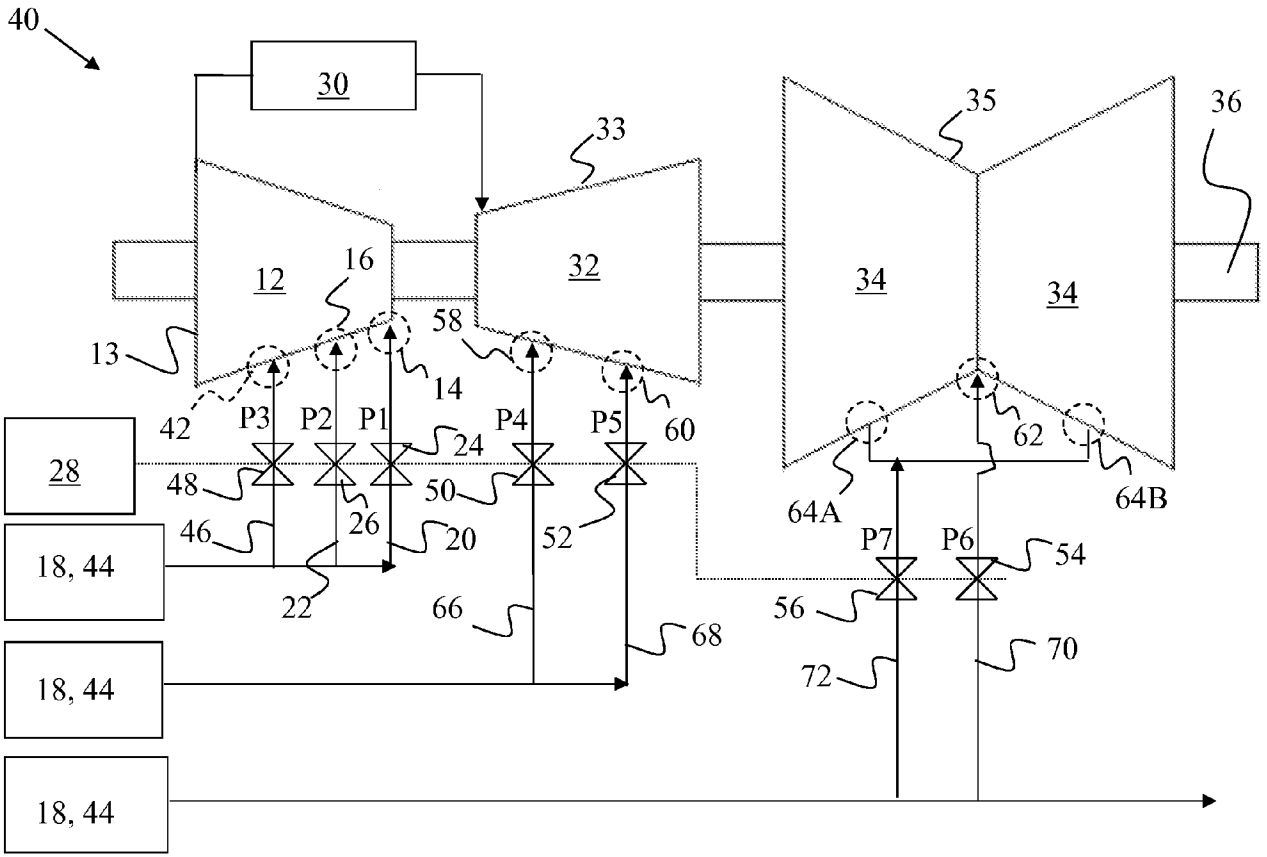
FIG. 2 shows a schematic view of a system according to an embodiment of the invention.

Turning to FIG. 1, a schematic view of a steam turbine system 10 is shown according to an embodiment of the invention. In this embodiment, steam turbine system 10 includes a steam turbine 12 having a casing 13 including a first inlet port 14 and a second inlet port 16 for receiving inlet steam (e.g., from a boiler 18). According to embodiments of the invention, steam turbine 12, and particularly, casing 13, may include additional inlet ports (FIG. 2). It is understood that first inlet port 14 and second inlet port 16 may include openings machined into steam turbine casing 13 of steam turbine 12. That is, aspects of the invention may include forming at least two inlet ports (e.g., inlet ports 14, 16, etc.) in the same section of the steam turbine casing 13 of steam turbine 12.

This may include molding and casting a portion of steam turbine casing 13 (e.g., the bottom half) to include the at least two inlet ports. In another embodiment, one or more of the at least two inlet ports (e.g., inlet ports 14, 16, etc.) may be formed after molding and casting of the casing, e.g., via drilling or boring. In any case, and in contrast to conventional steam turbines, casing 13 of steam turbine 12 may include multiple inlet ports in a single section (e.g., high-pressure section, intermediate-pressure section, and low-pressure section) for receiving inlet steam at different portions of the steam turbine cycle within that turbine section.

Returning to FIG. 1, steam turbine system 10 may further include a first conduit 20 and a second conduit 22 operably connected to a first valve 24 and a second valve 26, respectively. First conduit 20 and second conduit 22 may provide inlet steam to first inlet port 14 and second inlet port 16, respectively. First conduit 20 and second conduit 22 may include any conventional conduits used to carry steam in a steam turbine system, e.g., ducts or pipes made in part from metal, composite, polymers, etc. First valve 24 and second valve 26 may each have an open position and a closed position, wherein the closed position prevents flow of the inlet steam to steam turbine 12. Valves (e.g., valve 24 and/or valve 26) may be, for example, two-way valves. As is known in the art of fluid mechanics, a two-way valve either prevents a portion of the flow of a working fluid through a pathway, or allows a portion of that flow to pass. First valve 24 may primarily function in an open position (no obstruction), and second valve 26 may primarily function in a closed position (total obstruction). However, first valve 24 and/or second valve 26 may also function in a partially open position (partial obstruction). First valve 24 and/or second valve 26 may, for example, be a gate valve, a butterfly valve, a globe valve, etc.

System 10 may further include a control system 28 operably connected to first valve 24 and second valve 26, the control system 28 for controlling an amount of inlet steam admitted to each of first inlet port 14 and second inlet port 16. Control system 28 may be mechanically or electrically connected to first valve and second valve 26 such that control system 28 may actuate first valve 24 and/or second valve 26. Control system 28 may actuate first valve 24 and/or second valve 26 in response to a load change on steam turbine 12 (and similarly, a load change on system 10). Control system 28 may be a computerized, mechanical, or electro-mechanical device capable of actuating valves (e.g., valve 24 and/or valve 26). In one embodiment control system 28 may be a computerized device capable of providing operating instructions to first valve 24 and/or second valve 26. In this case, control system 28 may monitor the load of steam turbine 12 (and optionally, system 10) by monitoring the flow rates, temperature, pressure and other working fluid parameters of steam passing through steam turbine 12 (and system 10), and provide operating instructions to first valve 24 and/or second valve 26. For example, control system 28 may send operating instructions to open second valve 26 under certain operating conditions (e.g., to increase power output of steam turbine 12 or increase overall steam turbine performance during part-load conditions). In this embodiment, first valve 24 and/or second valve 26 may include electro-mechanical components, capable of receiving operating instructions (electrical signals) from control system 28 and producing mechanical motion (e.g., partially closing first valve 24 or second valve 26). In another embodiment, control system 28 may include a mechanical device, capable of use by an operator. In this case, the operator may physically manipulate control system 28 (e.g., by pulling a lever), which may actuate first valve 24 and/or second valve 26. For example, the lever of control system 28 may be mechanically linked to first valve 24 and/or second valve 26, such that pulling the lever causes the first valve 24 and/or second valve 26 to fully actuate (e.g., by opening the flow path through first conduit 20 and second conduit 22, respectively). In another embodiment, control system 28 may be an electro-mechanical device, capable of electrically monitoring (e.g., with sensors) parameters indicating the steam turbine 12 (and, optionally, system 10) is running at a certain load condition, and mechanically actuating first valve 24 and/or second valve 26. While described in several embodiments herein, control system 28 may actuate first valve 24 and/or second valve 26 through any other conventional means.

Also shown in FIG. 1 is a re-heater 30 configured to extract steam from steam turbine 12, reheat that extracted steam, and provide the reheated steam to a second steam turbine 32. Re-heater 30 may be any conventional re-heater used in a power plant, such as one that uses tubes and hot flue gases to provide heat energy to steam fed through the tubes. In one embodiment, steam turbine 12 may include a high pressure (HP) steam turbine section. Further, in one embodiment, second steam turbine 32 may include an intermediate pressure (IP) steam turbine section. Also shown in FIG. 1 is a third steam turbine 34 including, e.g., a low pressure (LP) steam turbine section. Third steam turbine 34 may include any conventional LP steam turbine section. However, as is shown in other embodiments (e.g., with reference to FIG. 2), third steam turbine 34 may include multiple inlet ports for receiving inlet steam from a steam source (e.g., boiler 18 or a heat recovery steam generator). Also shown in FIG. 1 is a shaft 36, which is configured to couple with, e.g., a load device (such as an electric generator, motor, etc.). Shaft 36 may be configured to transfer the rotational energy from one or more steam turbines (e.g., first steam turbine 12, second steam turbine 32, and/or third steam turbine 34) to a shaft of the load device, which may then convert that energy, e.g., to electricity. The electricity generation process is known in the art, and is therefore, not described further herein.

As shown in FIG. 1, first inlet port 14 is located at a higher pressure (e.g., higher admission pressure) location (P1) on steam turbine 12 than second inlet port 16 (located at pressure P2). That is, during operation of steam turbine 12, pressure conditions (P1) within steam turbine 12 at first inlet port 14 will be higher than those pressure conditions (P2) at second inlet port 16. In this vein, use of multiple inlet ports (e.g., inlet ports 14, 16) may provide advantages over conventional systems using a single inlet port. For example, in times of increased power need on a power generation system employing steam turbine 12, control system 28 may actuate second valve 26 to allow flow of inlet steam to second inlet port 16. Due to the flow capability of steam turbine 12 at first inlet port 14 and pressure condition (e.g., admission pressure condition) (P1), steam flow must be limited to that which inlet port 14 and this portion of steam turbine 12 will physically handle without causing stress on the casing of steam turbine 12. However, in times requiring increased output from steam turbine 12, control system 28 may allow for a greater amount of inlet steam to be provided to steam turbine 12 by at least partially opening second valve 26 and admitting inlet steam through second inlet port 16. As second inlet port 16 is located near a lower pressure (e.g., lower admission pressure) portion (P2) of steam turbine 12 than first inlet port 14, a greater amount of inlet steam can be admitted at second inlet port 16 when desired (e.g., when increased load/power output are desired) without exceeding the flow passing capability of steam turbine 12. It is understood that in one embodiment, e.g., in times of decreased steam turbine load, first valve 24 may be completely closed, while second valve 26 may be completely opened, allowing substantially all of the inlet steam to be admitted through second inlet port 16.

Turning to FIG. 2, a schematic view of steam turbine system 40 is shown according to an embodiment of the invention. While steam turbine system 40 may be configured to increase the power output of one or more steam turbines (e.g., turbines 12, 32, 34), it is understood that steam turbine system 40 may also be used to improve the efficiency of one or more steam turbines and/or an HRSG (e.g., HRSG 44) under part load or low-part load conditions. For example, where the power demand from steam turbine system 40 is reduced under part load or low-part load conditions, the pressure within one or more steam turbines (e.g., turbines 12, 32, 34) is decreased. This may cause a decrease in the pressure within HRSG 44, thereby decreasing its efficiency in producing steam. Embodiments shown and described with reference to FIG. 2 may allow, e.g., the HRSG 44 to operate at a higher pressure (closer to its optimum design conditions), while providing steam to lower-pressure portions of one or more steam turbines (e.g., turbines 12, 32, 34), thereby increasing the efficiency of both the HRSG and the one or more steam turbines (e.g., turbines 12, 32, 34). It is understood that the terms higher and lower pressures in this invention represent a generic variation in pressure level to achieve the required flow capacity and/or optimized partial load performance, this variation can either be higher or lower pressures and/or be a combination of multiple admission ports.

As shown in FIG. 2, steam turbine system 40 may include a high pressure section (steam turbine) 12, an intermediate pressure section (steam turbine) 32 having a casing 33, and a low pressure section (steam turbine 34) having a casing 35. Components similarly labeled in FIG. 1 and FIG. 2 may be substantially similar components, configured to perform substantially similar functions as described with reference to FIG. 1. As such, explanation of these commonly shown components has been omitted for brevity. In this light, FIG. 2 shows first inlet port 14 and second inlet port 16, respectively of steam turbine 12 (e.g., a high pressure steam turbine). Also shown in FIG. 2 is steam turbine 12 including casing 13 having a third inlet port 42 (shown in phantom as optional) for receiving a portion of inlet steam from a steam source (e.g., boiler 18 or a high-pressure drum of a heat recovery steam generator 44). Further shown is a third conduit 46 operably connected to a third valve 48 and third inlet port 42. Control system 28 may be operably connected to third valve 48 (as well as first valve 24 and second valve 26) and may be configured to control an amount of inlet steam admitted to each of first inlet port 14, second inlet port 16 and third inlet port 42, respectively, via actuating first valve 24, second valve 26 and/or third valve 48. It is understood that third inlet port 42 may be formed substantially similarly as first inlet port 14 and second inlet port 16. It is further understood that third conduit 46 and third valve 48 may be substantially similar to other conduits (20, 22) and valves (24, 26), respectively, described herein. As similarly described with reference to system 10 of FIG. 1, control system 28 may be configured to actuate each inlet valve (24, 26, 48) to allow for increased and/or optimum steam flow from the steam source (boiler 18 or HRSG 44) at a location of lower pressure in steam turbine 12. In embodiments including a third inlet port 42, additional steam may be supplied to steam turbine 12 at a location of lower pressure (pressure P3, at third inlet port 42) than second inlet port 16 (pressure P2). This may allow for even greater power augmentation and/or higher cycle efficiency at partial load operation when desired, as the flow passing capability of steam turbine 12 at third inlet port 42 is greater than at second inlet port 16.

Control system 28 may be further configured to control a fourth valve 50, fifth valve 52, sixth valve 54, and a seventh valve 56 substantially similarly as first valve 24 and second valve 26. Further, additional valves (e.g., 50, 52, 54, 56, etc.) may be substantially similar to either of first valve 24 or second valve 26. Also shown in FIG. 2 are additional ports, e.g., a fourth inlet port 58 and a fifth inlet port 60 included in casing 33 of second steam turbine 32 (e.g., intermediate pressure steam turbine), and sixth inlet port 62 and seventh inlet ports (64A and 64B for a double-flow low pressure steam turbine) included in casing 35 of third steam turbine 34 (e.g., a double-flow low pressure steam turbine). Also shown are additional conduits, e.g., a fourth conduit 66 and fifth conduit 68 operably attached to fourth valve 50 and fifth valve 52, respectively, and sixth conduit 70 and seventh conduit 72 operably attached to sixth valve 54 and seventh valve 56, respectively. Additional ports (e.g., 58, 60, 62, 64A, 64B) and conduits (e.g., 66, 68, 70, 72) may be substantially similar, respectively, to first and second ports 14, 16 and first and second conduits 20, 22.

As is understood in the art, intermediate pressure (IP) steam turbine 32 may receive intermediate pressure steam from either boiler 18 or an intermediate pressure drum portion of HRSG 44. According to aspects of the invention, control system 28 may actuate fourth valve 50 and/or fifth valve 52 to provide intermediate pressure steam to a lower pressure location (e.g., having a lower admission pressure) (at pressure P5) of IP steam turbine 32. For example, in one embodiment, control system 28 may actuate fifth valve 52 to allow intermediate pressure steam to bypass fourth inlet port 58, allowing IP steam turbine 32 to increase its output.

As is additionally known in the art, low pressure (LP) steam turbine 34 may receive low pressure steam from either boiler 18 or a low pressure drum portion of HRSG 44. According to aspects of the invention, control system 28 may actuate sixth valve 54 and/or seventh valve 56 to provide low pressure steam to lower pressure locations (at pressure P7) of LP steam turbine 34. For example, in one embodiment, control system 28 may actuate seventh valve 56 to allow low pressure steam to bypass sixth inlet port 62, allowing LP steam turbine 34 to increase its output.

In another embodiment, control system 28 may actuate one or more valves (24, 26, 50, 52, etc.) to increase the efficiency of steam turbine system 40. For example, in the case where steam turbine system 40 is operating under part load conditions (e.g., at conditions below approximately 100% of the steam turbine's rated power/mass flow), the reduced mass flow of steam may cause inefficiencies in one or more of first turbine 12, second turbine 32 and/or third turbine 34. That is, each of first steam turbine 12, second steam turbine 32 and third steam turbine 34 are designed to run at particular rated power/mass flow levels to provide maximum efficiency, e.g., in helping to generate electricity. However, under part load conditions, the efficiency of one or more of the steam turbines (12, 32, 34) may be reduced, as the mass flow of steam through the steam turbine is reduced or not optimum due to off-design pressure settings. Conventional steam turbines receive inlet steam from a single inlet port (in the casing), allowing the steam to expand and perform mechanical work across all stages of the steam turbine. Due to the non-optimum pressure levels provided by the steam turbine to the HRSG, this process may cause inefficiencies in the steam turbine cycle.

In contrast to conventional steam turbine systems, system 10 and system 40 are configured to redirect inlet steam from an inlet port of each steam turbine casing (e.g., HP steam turbine 12, IP steam turbine 32 and/or LP steam turbine 34) to a distinct inlet port of the casing at a desired pressure location of the turbine at various load conditions. For example, in the case that LP steam turbine 34 is operating under part load conditions, control system 28 may at least partially close sixth inlet valve 54 and at least partially open seventh inlet valve 56 to allow inlet steam to enter LP steam turbine 34 at lower pressure locations (inlet ports 64A, 64B), thereby reducing the inefficiency of LP steam turbine 34.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system comprising:

a steam turbine section having a first inlet port and a second inlet port for receiving inlet steam, wherein the first inlet port is located at a higher pressure location on the steam turbine than the second inlet port;

a first conduit and a second conduit operably connected to a first valve and a second valve, respectively, the first conduit and the second conduit for providing the inlet steam to the first inlet port and the second inlet port, respectively; and an electro-mechanical control system operably connected to the first valve and the second valve for controlling an amount of inlet steam admitted to each of the first inlet port and the second inlet port based upon a load demand on the steam turbine and an admission pressure of the inlet steam, wherein the electro-mechanical control system is configured to at least partially open the second valve in response to a decrease in the load demand on the steam turbine and at least partially close the first valve in response to the decrease in the load demand on the steam turbine.

2. The system of claim 1, wherein the electro-mechanical control system is configured to at least partially open the second valve in response to an increase in the load demand on the steam turbine.

3. The system of claim 1, further comprising a steam source fluidly connected to the first conduit and the second conduit.

4. The system of claim 3, wherein the steam source is at least one of a boiler or a heat recovery steam generator (HRSG).

5. The system of claim 1, wherein the least partially opening of the second valve in response to a decrease in the load demand on the steam turbine and the at least partially closing of the first valve in response to the decrease in the load demand on the steam turbine increases the efficiency of the steam turbine section.

6. A steam turbine system comprising:

a high pressure section including:

a high pressure (HP) steam turbine having a first inlet port and a second inlet port for receiving a first inlet steam; and a first conduit and a second conduit operably connected to a first valve and a second valve, respectively, the first conduit and the second conduit for providing the inlet steam to the first inlet port and the second inlet port, respectively;

an intermediate pressure section including:

an intermediate pressure (IP) steam turbine having a third inlet port and a fourth inlet port for receiving a second inlet steam; and a third conduit and a fourth conduit operably connected to a third valve and a fourth valve, respectively, the third conduit and the fourth conduit for providing the second inlet steam to the third inlet port and the fourth inlet port, respectively, wherein the first inlet port is located at a higher pressure location on the HP steam turbine than the second inlet port, and wherein the third inlet port is located at a higher pressure location on the IP steam turbine than the fourth inlet port; and an electro-mechanical control system operably connected to the first valve, the second valve, the third valve, and the fourth valve, the control system controlling an amount of the first and second inlet steam admitted to each of the first, second, third and fourth inlet ports based upon a load demand on the steam turbine and an admission pressure of the first inlet steam and the second inlet steam.

7. The steam turbine system of claim 6, further comprising a steam source fluidly connected to the first, second, third and fourth conduits.

8. The steam turbine system of claim 7, wherein the steam source is a heat recovery steam generator (HRSG).

9. The steam turbine system of claim 8, wherein the HRSG includes at least one of a high pressure drum, an intermediate pressure drum or a low pressure drum.

10. The steam turbine system of claim 6, wherein the electro-mechanical control system is configured to at least partially open the second valve in response to an increase in the load demand on the steam turbine.

11. The steam turbine system of claim 6, wherein the electro-mechanical control system is configured to at least partially open the second valve in response to a decrease in the load demand on the steam turbine.

12. A steam turbine casing having a high pressure section, an intermediate pressure section and a low pressure section, the casing including:

at least two steam inlet ports in each of the at least one of the high pressure section, the intermediate pressure section or the low pressure section.

13. The steam turbine casing of claim 12, wherein a first one of the at least two steam inlet ports is located at a higher pressure location on the steam turbine than a second inlet port of the at least two inlet ports.

* * * * *